US009060397B2

(12) United States Patent
Roberts et al.

(10) Patent No.: US 9,060,397 B2
(45) Date of Patent: Jun. 16, 2015

(54) HIGH VOLTAGE LED AND DRIVER

(75) Inventors: Bruce Richard Roberts, Mentor-on-the-Lake, OH (US); Louis Nerone, Brecksville, OH (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 727 days.

(21) Appl. No.: 13/183,879

(22) Filed: Jul. 15, 2011

(65) Prior Publication Data

US 2013/0015768 A1 Jan. 17, 2013

(51) Int. Cl.
*H05B 37/02* (2006.01)
*H05B 33/08* (2006.01)

(52) U.S. Cl.
CPC ..... *H05B 33/0815* (2013.01)

(58) Field of Classification Search
USPC ..... 315/209 R, 247, 291, 308
See application file for complete search history.

(56) References Cited

U.S. PATENT DOCUMENTS

| | | | | |
|---|---|---|---|---|
| 7,511,437 | B2 * | 3/2009 | Lys et al. | 315/307 |
| 7,919,918 | B2 * | 4/2011 | Kim | 313/506 |
| 8,497,636 | B2 * | 7/2013 | Nerone | 315/210 |
| 2009/0146732 | A1 | 6/2009 | Wu | |
| 2009/0262527 | A1 | 10/2009 | Chou | |
| 2009/0273290 | A1 * | 11/2009 | Ziegenfuss | 315/193 |
| 2010/0207536 | A1 * | 8/2010 | Burdalski et al. | 315/224 |
| 2010/0315572 | A1 | 12/2010 | LoCascio | |
| 2010/0320936 | A1 | 12/2010 | Yao | |
| 2011/0037399 | A1 | 2/2011 | Hung et al. | |
| 2011/0043133 | A1 | 2/2011 | Van Laanen et al. | |
| 2012/0169240 | A1 * | 7/2012 | Macfarlane | 315/152 |
| 2012/0229044 | A1 * | 9/2012 | Nerone | 315/210 |
| 2014/0042926 | A1 * | 2/2014 | Melanson | 315/247 |

FOREIGN PATENT DOCUMENTS

| | | | |
|---|---|---|---|
| EP | 2389046 | A2 | 11/2011 |
| WO | 2008068682 | A1 | 6/2008 |
| WO | 2008137460 | A2 | 11/2008 |
| WO | 2011063205 | A1 | 5/2011 |

OTHER PUBLICATIONS

PCT Search Report and Written Opinion dated Oct. 9, 2012 from corresponding Application No. PCT/US2012/046345.

* cited by examiner

*Primary Examiner* — Thuy Vinh Tran
(74) *Attorney, Agent, or Firm* — Pearne & Gordon LLP

(57) ABSTRACT

A method and apparatus for providing illumination by driving LEDs using a high-voltage driver, and more specifically a method and apparatus for using a simplified boost circuit connected to an AC mains to provide a higher voltage DC driving voltage to the LED array.

23 Claims, 5 Drawing Sheets

HIGH VOLTAGE LED AND DRIVER

FIELD OF THE INVENTION

This application relates generally to driving LEDs using a high-voltage driver, and more specifically this application relates to an apparatus and method for using a current controlled boost circuit connected to an AC mains to provide a higher voltage DC power to the LED array.

BACKGROUND OF THE INVENTION

Using LEDs for lighting applications is becoming more and more popular as the cost of LEDs drops due to manufacturing improvements. LED lighting often utilizes an array of individual LEDs, such as a plurality of LEDs connected in series, to increase the amount of light outputted to a desired amount. Because LEDs typically operate from a DC voltage source, the AC voltage that is typically found as a power source needs to be converted to DC power in order to drive the LED array, and thus an LED driver is provided to convert the AC source to a DC power supply for driving the array.

However, current systems provide DC voltage outputs that are typically less than the voltage of the AC source, which is often at 120V for household applications. It has been determined that it would be desirable to increase the voltage at which an LED array operates to an amount that is greater than the line voltage, but it is always desirable to reduce the size, cost, and number of components that are utilized in such lighting application. Accordingly, desirable would be a way to provide a high-voltage DC power source higher than the AC source voltage for driving an LED array while also reducing the cost, complexity, and size of the components utilized.

SUMMARY OF THE INVENTION

Provided are a plurality of embodiments the invention, including, but not limited to, an apparatus comprising: an LED array including a plurality of LEDs connected in a series for providing illumination; and an LED driver for providing an operating voltage to the LED array. The LED driver includes a rectifier circuit for rectifying an AC power source into a DC power source providing a DC source voltage; a filter for filtering the DC source voltage; a voltage boost circuit for boosting the DC source voltage for providing an LED drive voltage; and an oscillating circuit for driving the voltage boost circuit at an oscillation frequency, wherein the oscillating boost circuit is self-oscillating.

Also provided is an apparatus comprising: an LED array including a plurality of LEDs connected in a series for providing illumination; and an LED driver for providing an operating voltage to the LED array. The LED driver includes: a rectifier circuit for rectifying an AC power source into a DC power source providing a DC source voltage having an RMS voltage value about equal to the RMS voltage value of the AC power source; a filter for filtering the DC source voltage; a voltage boost circuit for boosting the DC source voltage for providing an LED drive voltage; and an oscillating circuit for driving the voltage boost circuit at an oscillation frequency, wherein the oscillating boost circuit is self-oscillating.

For the above apparatus, the LED drive voltage can be utilized for driving the LED array such that the voltage drop across the LED array has an RMS voltage value that is greater than the RMS voltage value of the AC power source.

Still further provided is an apparatus comprising: an LED array including a plurality of LEDs connected in a series for providing illumination; and an LED driver for providing an operating voltage to the LED array. The LED driver includes: a rectifier circuit for rectifying an AC power source into a DC power source providing a DC source voltage having an RMS voltage value about equal to the RMS voltage value of the AC power source; a filter for filtering the DC source voltage; a voltage boost circuit for boosting the DC source voltage for providing an LED drive voltage; an oscillating circuit for driving the voltage boost circuit at an oscillation frequency, wherein the oscillating boost circuit is self-oscillating; a bootstrap oscillator power supply for providing power to the oscillating circuit during a power-up phase; an oscillator power supply for supplying power to the oscillator after the power-up phase; a current detecting circuit for controlling a duty cycle of the boost circuit; and a current averaging circuit for filtering out voltage peaks otherwise provided in the oscillating circuit, For the above apparatus, the LED drive voltage is utilized for driving the LED array such that the voltage drop across the LED array has an RMS voltage value that is greater than the RMS voltage value of the AC power source.

Also provided is an LED Driver for driving an LED array, the LED driver comprising: a rectifier circuit for rectifying an AC power source into a DC power source providing a DC source voltage having an RMS voltage value about equal to the RMS voltage value of the AC power source; a filter for filtering the DC source voltage; a voltage boost circuit for boosting the DC source voltage for providing an LED drive voltage; an oscillating circuit for driving the voltage boost circuit at an oscillation frequency, wherein the oscillating boost circuit is self-oscillating; a bootstrap oscillator power supply for providing power to the oscillating circuit during a power-up phase; an oscillator power supply for supplying power to the oscillator after the power-up phase; a current detecting circuit for controlling a duty cycle of the boost circuit; and a current averaging circuit for filtering out voltage peaks otherwise provided in the oscillating circuit.

For the above driver, the LED drive voltage is utilized such that the voltage drop across an output has an RMS voltage value that is greater than the RMS voltage value of the AC power source. Furthermore, a power efficiency of the LED driver is greater than 90%.

Also provided are any of the above devices further comprising a dimmer compatibility circuit that is inactive when dimming is not being performed and active when dimming is being performed.

Further provided are any above devices having a power efficiency of greater than 90%, or a power efficiency equal to or greater than 95%.

Also provided are additional embodiments of the invention, some, but not all of which, are described hereinbelow in more detail.

BRIEF DESCRIPTION OF THE DRAWINGS

The features and advantages of the examples of the present invention described herein will become apparent to those skilled in the art to which the present invention relates upon reading the following description, with reference to the accompanying drawings, in which.

DETAILED DESCRIPTION OF THE EXAMPLE EMBODIMENTS

Generally, a boost circuit is utilized to boost the line voltage to operate an LED array at a higher voltage, in order to improve efficiencies of operation. The boost circuit is designed for high efficiency.

Figure 1:
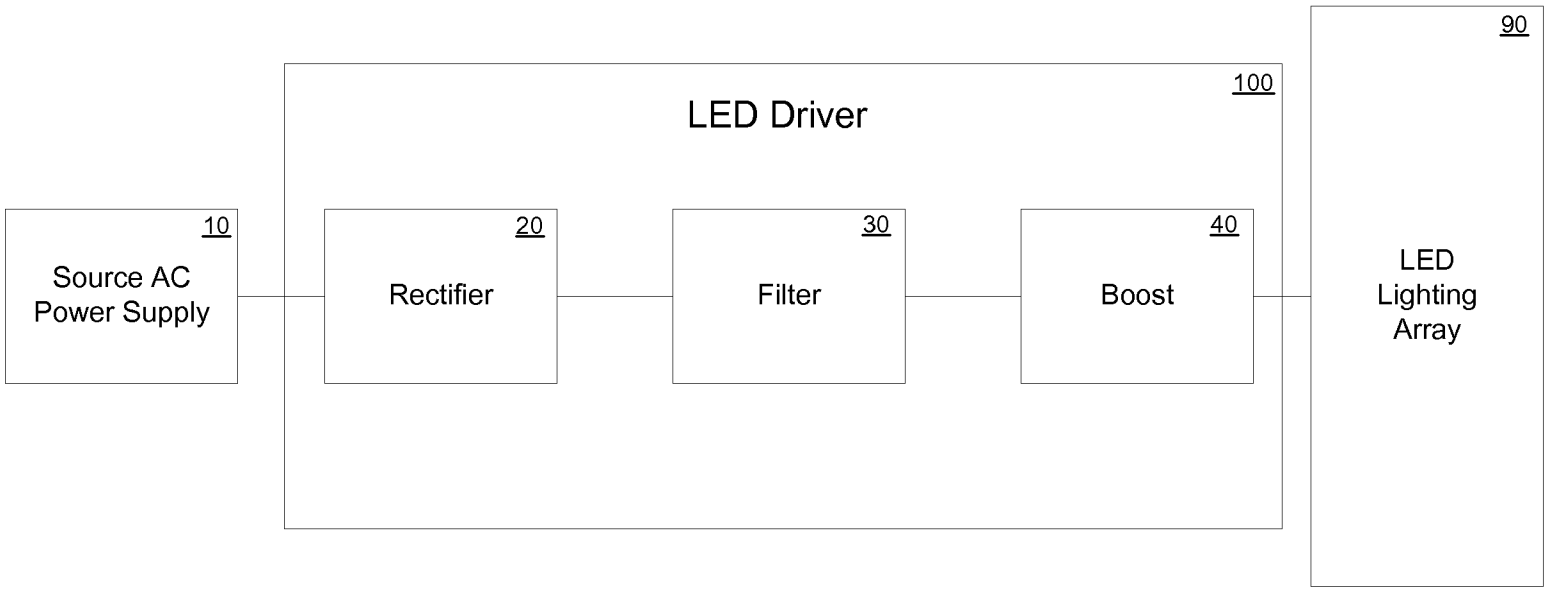
FIG. 1 shows a simplified block diagram of one example embodiment of the LED driver and LED array.

FIG. 1 is an example simplified block diagram showing the primary components a system, including an LED Driver 100 for driving an LED lighting array 90. Primarily, the driver 100 will include a rectifier circuit for rectifying an AC power source 10 (such as a 120Vac residential power supply), that is preferably adapted for aiding in compatibility with dimming circuits. The driver 100 is also comprised of a filter 30 to filter out electromagnetic interference. The driver is also comprised of a boost component 40 for boosting the rectified and filtered power for providing a constant current to the LED lighting array 90.

Figure 2:
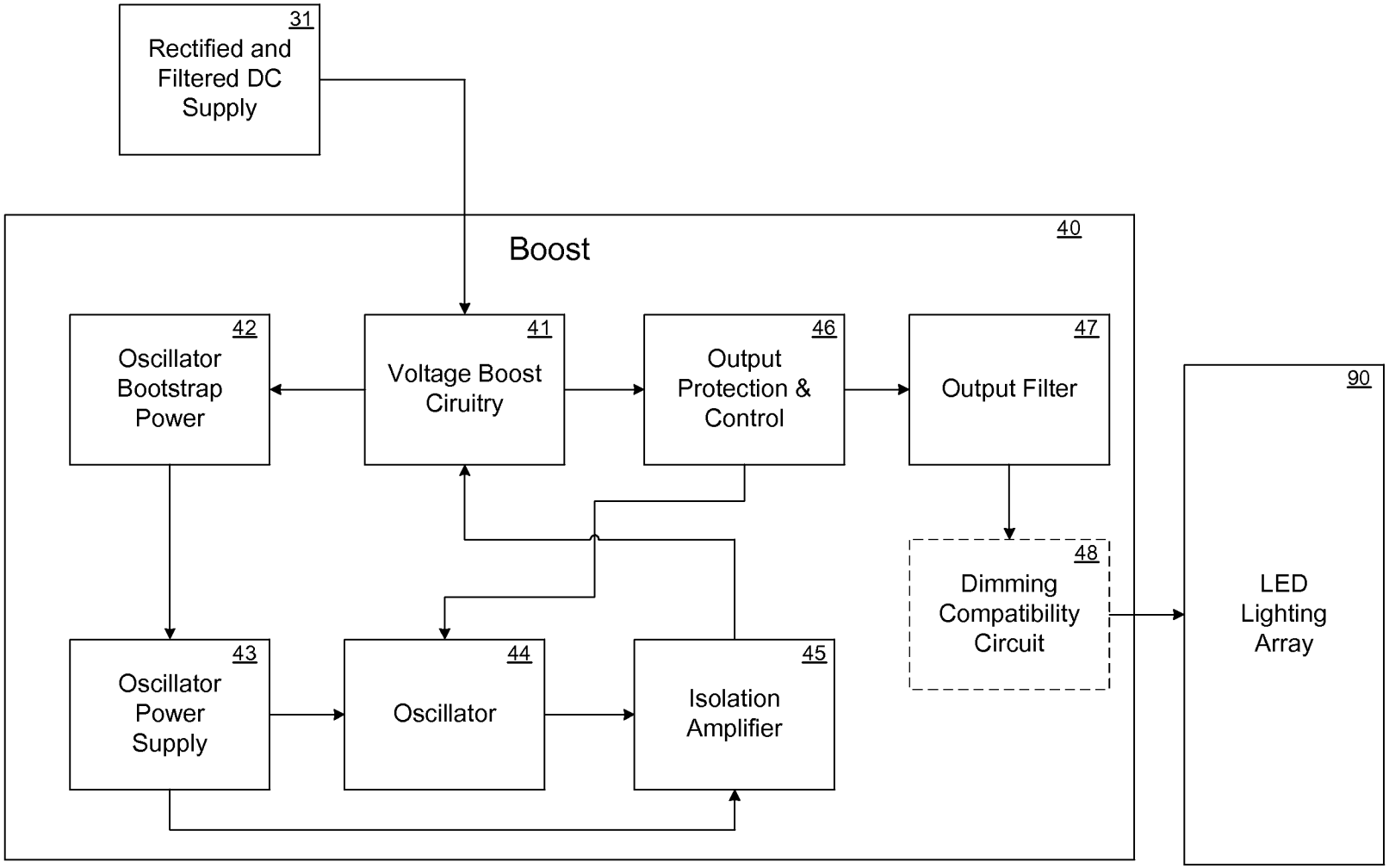
FIG. 2 shows a block diagram of an example embodiment of an example boost component of the LED driver.

FIG. 2 shows a block diagram of the boost component 40 of the example simplified system of FIG. 1 in more detail. The boost component is comprised of voltage boost circuitry 41 for boosting the rectified and filtered DC power 31 and controlling the output current. The boost circuitry is driven by an oscillator 44 through an isolation amplifier 45. The isolation amplifier 45 is used to isolate the oscillator 44 from the boost circuit 41 in order to avoid a large current drain from the boost circuit 41 that might otherwise affect the operation of the oscillator 44.

The Oscillator 44 is powered by an Oscillator power supply 43 that receives power from the boost circuit 41, but because on startup the boost circuit 41 needs time to come up to a steady operating state, the oscillator bootstrap power circuit 42 is provided to initially provide startup power to the oscillator 44. The oscillator 44 sets the operating frequency of the voltage boost circuit, as described in more detail hereinbelow.

An output protection and control circuit 46 is provided to perform a number of protection functions for the boost device 40. For example, the output protection and control circuit 46 prevents large peak currents from feeding the oscillator circuit, it controls the duty cycle of the boost circuit, and it performs overvoltage control of the boost circuit output.

An output filter 47 is provided to filter out ripple currents output by the boost circuit 41, and to provide further dimmer compatibility. A dimming compatibility circuit 48 can also be provided to further improve compatibility with dimming circuits.

Figure 3:
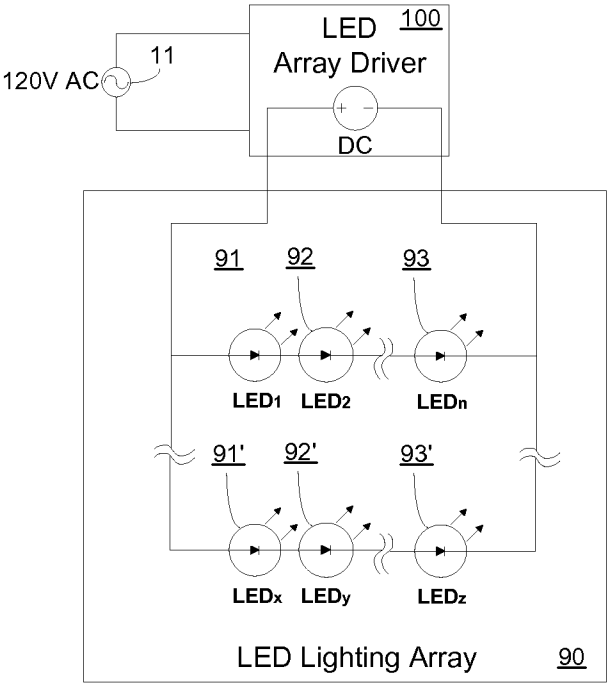
FIG. 3 shows a schematic diagram of an example LED array being driven by the example LED driver.

FIG. 3 shows a schematic diagram of an LED lighting device including an LED array driver 100 driving an example LED array 90 comprising a plurality of LEDs 91, 92 . . . 93 connected in one series string and another plurality of LEDs 91', 92' . . . 93' connected in another series string, where a plurality of such series strings of LEDs are shown connected in parallel. By using one of the drivers disclosed herein that provide a voltage boost to drive the LEDs, more LEDs can be put into each series string, decreasing the number of strings that would be necessary to provide in parallel for a desired amount of illumination, thereby increasing the overall efficiency of the entire lighting device.

Of course, various numbers of LEDs could be provided in each series string depending on the output voltage of the LED array driver and also depending on the voltage drop across the LEDs. For example, where the voltage drop across each LED is about 3V, and the output of the driver 100 is about 200V, a series string would have 66 LEDs. Furthermore, any number of LED strings could be connected in parallel depending on the total light output that was desired, from 1 string to 2 or more strings. Of course, each additional string connected in parallel increases the current that must be provided by the driver 100 by an integer multiple amount, thereby increasing the required size (power capacity) of its components.

Figure 4:
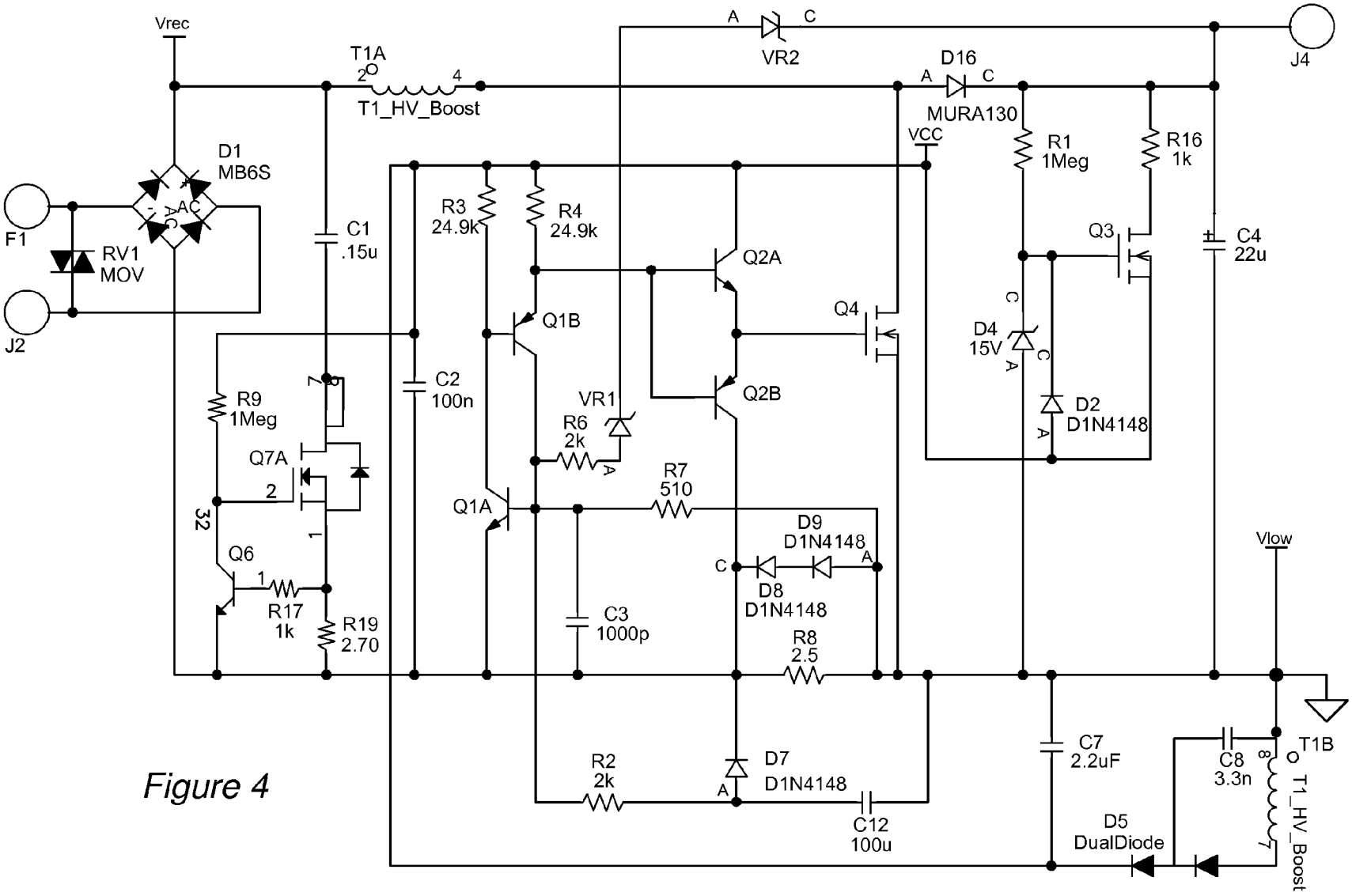
FIG. 4 shows a schematic diagram of an example embodiment of an LED driver.

FIG. 4 shows a schematic of an example implementation of the LED driver. The rectifier is provided by D1 bridge rectifier, with capacitor C1 provided as an input filter and including FET Q7A along with its driving circuit (using transistor bipolar Q6) acting to limit the filter surge current for better compatibility with triac dimmers. The oscillating circuit is comprised of Q1A and Q1B, provided with C2 R3, and R4, and R5, oscillating based on the values of the components of the RC circuit comprised of R7 and C3 which determine the oscillating frequency of the oscillating circuit, in this case about 100 kHz. A push-pull amplifier is provided by Q2A and Q2B, which isolate the oscillating circuit from the boost circuit.

The boost circuit is provided by transformer winding T1A, Q4, and D16. Basically, the oscillating circuit drives Q4 to switch on and off at the oscillating frequency (about 100 kHz), leading T1A to charge when Q4 is on, and forcing T1*a* to discharge into the LED load(s) while boosting the load voltage when Q4 is turned off. The push-pull amplifier prevents Q4 from drawing too much current from the oscillating circuit during this switching operation, as drawing too much current could otherwise shut down the oscillation.

The oscillation circuit is powered by an oscillator power supply (supplying $V_{cc}$) comprising a secondary winding of the transformer T1B, in combination with blocking dual diode D5 and C8 acting as a filter to average out the voltage output by T1B. However, upon startup, because the boost circuit is not yet charged and the oscillating circuit not yet oscillating, a bootstrap startup power supply comprised of D2, R1, R16, and Q3, with zener diode D4 acting as a voltage regulator (set at 15V in the example), are arranged as shown for providing an initial $V_{cc}$ to start the oscillating and boost circuits. The bootstrap circuit detects when the oscillator power supply is sufficiently charged and operating, at which time Q1 is turned off to basically shut off the current provided by the bootstrap power supply.

Three components/circuits are provided in the example embodiment of FIG. 4 to support various output protection and control functions. Zener diodes VR1 and VR2 act to shut down the oscillating circuit if there is an overvoltage condition for protecting the output voltage of the driver. Diode D7 along with capacitor C12 act in tandem as a current averaging circuit to smooth out currents feeding the oscillating circuit to avoid large peak currents to both improve efficiency and avoid overvoltage conditions. Finally, resistor R8 acts with protection diodes D8 and D9 as a current sense resister used for determining the duty cycle of the boost circuit.

The circuit of FIG. 4 provides a very high-efficiency boost driver circuit for providing a drive voltage to the external LED array that has a higher RMS voltage than the line voltage provided to the driver circuit, which allows for a lower load current than would be required if portions of the LEDs were provided in parallel. This leads to greatly reduced $I^2R$ losses through Q5 than might otherwise occur, greatly improving the efficiency of the device. The example circuit of FIG. 4 provides an efficiency that is greater than 90%, with efficiencies of about 95% or more being practical, and can support output currents at an output voltage of up to 250V or more. Boost converters can be utilized for up to a 5-to-1 ratio and this design can therefore drive any series/ parallel combination of LEDS that did not exceed approximately 1000V. Higher currents are also possible by proper sizing of the primary current path components.

Figure 5:
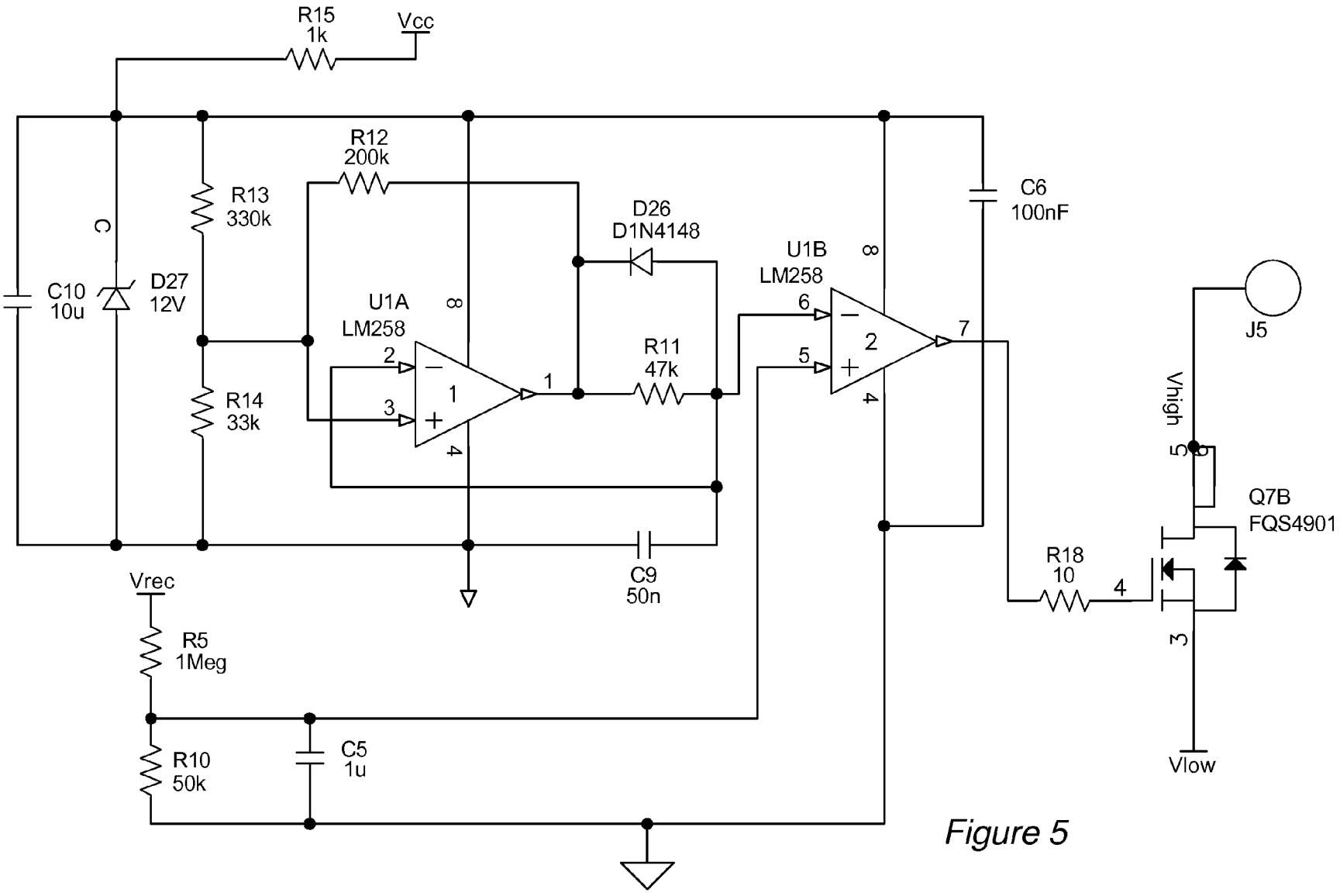
FIG. 5 shows a schematic diagram of an example embodiment of a dimmer compatibility circuit for the example LED driver of FIG. 4.

FIG. 5 is a schematic diagram of a dimmer compatibility circuit that can be added to the LED driver of FIG. 4. This circuit is not active during normal operation, but assists during the dimming mode. Its function is to introduce a lower frequency (1000 Hz in this example) PWM to the output to lower the average current to the LEDs based on the average input AC line voltage. It accomplishes this by producing a self oscillating sawtooth waveform (U1A) which is compared (U1B) to a representative sample of the line voltage (R5, R10, and C5)). As the average line input decreases below a set point, the output will begin to PWM using Q7B. The duty cycle will decrease as the average input voltage decreases until the light reaches its minimum programmed level.

The dimmer compatibility circuit is added in applications where the LED array is desired to have broad compatibility with dimmer circuits and provides a more desirable incandescent lamp equivalent type of dimming curve. It also provides a lower programmed light output at the minimum dimmer setting inputs and assists with slowly starting the light output on the way up when increasing the dimming input.

Thus, the dimmer compatibility circuit can be utilized with the example LED driver circuit(s) to provide a more adaptable solution for replacing incandescent lighting. Accordingly, an LED driver as disclosed herein, along with the dimmer compatibility circuit, if such compatibility is desired, can be utilized in an LED lighting system for use as replacements to existing solutions designed for incandescent lighting (such as for replacing a 100 watt A-19 incandescent lamp, for example), or for new lighting situations where incandescent lighting may have been preferable in the past. Furthermore, the LED driver can be used in new customized lighting solutions where high-efficiency LED lighting is desirable, such as for public lighting, office lighting, etc.

Many other example embodiments of the invention can be provided through various combinations of the above described features. Although the invention has been described hereinabove using specific examples and embodiments, it will be understood by those skilled in the art that various alternatives may be used and equivalents may be substituted for elements and/or steps described herein, without necessarily deviating from the intended scope of the invention. Modifications may be necessary to adapt the invention to a particular situation or to particular needs without departing from the intended scope of the invention. It is intended that the invention not be limited to the particular implementations and embodiments described herein, but that the claims be given their broadest reasonable interpretation to cover all novel and non-obvious embodiments, literal or equivalent, disclosed or not, covered thereby.

What is claimed is:

1. An apparatus comprising:

an LED array including a first plurality of LEDs connected in a series, and a second plurality of LEDs connected in series, the second plurality of LEDs being connected in parallel with the first plurality of LEDs, for providing illumination; and an LED driver for providing an operating voltage to said LED array, said LED driver including:

a rectifier circuit for rectifying an AC power source into a DC power source providing a DC source voltage;

a filter for filtering the DC source voltage;

a voltage boost circuit for boosting the DC source voltage for providing an LED drive voltage;

an oscillating circuit for driving the voltage boost circuit at an oscillation frequency, wherein the oscillating circuit is self-oscillating;

a bootstrap oscillator power supply for providing power to the oscillating circuit during a power-up phase; and an oscillator power supply for supplying power to the oscillating circuit after said power-up phase.

2. The apparatus of claim 1, said LED driver further comprising:

a current detecting circuit for controlling a duty cycle of said voltage boost circuit; and a current averaging circuit for filtering out voltage peaks otherwise provided in said oscillating circuit.

3. The apparatus of claim 2, further comprising an overvoltage component to stop the oscillation of said oscillating circuit during an overvoltage condition.

4. The apparatus of claim 1, said LED driver further comprising an input filter connected to said rectifier, said input filter including a surge current limiting device.

5. The apparatus of claim 1, wherein said voltage boost circuit is comprised of an inductor and a switch driven by said oscillating circuit for switching a current from the inductor between ground and the LED array.

6. The apparatus of claim 1, wherein said AC power source is a 120Vac mains supply, and wherein said voltage drop across the LED array is at least about 200Vdc.

7. The apparatus of claim 1, wherein said LED driver has a power efficiency of at least 90%.

8. The apparatus of claim 1, wherein said LED driver has a power efficiency of greater than or equal to about 95%.

9. The apparatus of claim 1, further comprising a dimmer compatibility circuit that is inactive when dimming is not being performed on the LED array and active when dimming is being performed on the LED array.

10. An apparatus comprising:

an LED array including a plurality of LEDs connected in a series for providing illumination; and an LED driver for providing an operating voltage to said LED array, said LED driver including:

a rectifier circuit for rectifying an AC power source into a DC power source providing a DC source voltage having an RMS voltage value about equal to the RMS voltage value of the AC power source;

a filter for filtering the DC source voltage;

a voltage boost circuit for boosting the DC source voltage for providing an LED drive voltage;

an oscillating circuit for driving the voltage boost circuit at an oscillation frequency, wherein the oscillating boost circuit is self-oscillating;

a bootstrap oscillator power supply for providing power to the oscillating circuit during a power-up phase; and an oscillator power supply for supplying power to the oscillating circuit after said power-up phase, wherein said LED drive voltage is utilized for driving the LED array such that the voltage drop across the LED array has an RMS voltage value that is greater than the RMS voltage value of the AC power source.

11. The apparatus of claim 10 further comprising an overvoltage component to stop the oscillation of said oscillating circuit during an overvoltage condition.

12. The apparatus of claim 10, said LED driver further comprising an input filter connected to said rectifier, said input filter including a surge current limiting device.

13. The apparatus of claim 10, wherein said voltage boost circuit is comprised of an inductor and a switch driven by said oscillating circuit for switching a current from the inductor between ground and the LED array.

14. The apparatus of claim 10, wherein said AC power source is a 120Vac mains supply, and wherein said voltage drop across the LED array is at least about 200Vdc.

15. The apparatus of claim 10, wherein said LED driver has a power efficiency of greater than 90%.

16. The apparatus of claim 10, further comprising a dimmer compatibility circuit that is inactive when dimming is not being performed on the LED array and active when dimming is being performed on the LED array.

17. An apparatus comprising:

an LED array including a plurality of LEDs connected in a series for providing illumination; and an LED driver for providing an operating voltage to said LED array, said LED driver including:

a rectifier circuit for rectifying an AC power source into a DC power source providing a DC source voltage having an RMS voltage value about equal to the RMS voltage value of the AC power source;

a filter for filtering the DC source voltage;

a voltage boost circuit for boosting the DC source voltage for providing an LED drive voltage;

an oscillating circuit for driving the voltage boost circuit at an oscillation frequency, wherein the oscillating boost circuit is self-oscillating;

a bootstrap oscillator power supply for providing power to the oscillating circuit during a power-up phase;

an oscillator power supply for supplying power to the oscillating circuit after said power-up phase;

a current detecting circuit for controlling a duty cycle of said boost circuit; and a current averaging circuit for filtering out voltage peaks otherwise provided in said oscillating circuit, wherein said LED drive voltage is utilized for driving the LED array such that the voltage drop across the LED array has an RMS voltage value that is greater than the RMS voltage value of the AC power source.

18. The apparatus of claim 17 further comprising an overvoltage component to stop the oscillation of said oscillating circuit during an overvoltage condition.

19. The apparatus of claim 17, said LED driver further comprising an input filter connected to said rectifier, said input filter including a surge current limiting device.

20. The apparatus of claim 17, wherein said AC power source is a 120Vac mains supply, and wherein said voltage drop across the LED array is at least about 170Vdc.

21. The apparatus of claim 17, wherein said LED driver has a power efficiency of greater than 90%.

22. An LED Driver for driving an LED array, said LED driver comprising:

a rectifier circuit for rectifying an AC power source into a DC power source providing a DC source voltage having an RMS voltage value about equal to the RMS voltage value of the AC power source;

a filter for filtering the DC source voltage;

a voltage boost circuit for boosting the DC source voltage for providing an LED drive voltage;

an oscillating circuit for driving the voltage boost circuit at an oscillation frequency, wherein the oscillating boost circuit is self-oscillating;

a bootstrap oscillator power supply for providing power to the oscillating circuit during a power-up phase;

an oscillator power supply for supplying power to the oscillator after said power-up phase;

a current detecting circuit for controlling a duty cycle of said boost circuit; and a current averaging circuit for filtering out voltage peaks otherwise provided in said oscillating circuit, wherein said LED drive voltage is utilized such that the voltage drop across an output has an RMS voltage value that is greater than the RMS voltage value of the AC power source, and wherein a power efficiency of said LED driver is greater than 90%.

23. The LED driver of claim 22, further comprising a dimmer compatibility circuit that is inactive when dimming is not being performed and active when dimming is being performed.

* * * * *